US005660001A

United States Patent [19]

Albracht

[11] Patent Number: 5,660,001

[45] Date of Patent: Aug. 26, 1997

[54] GUTTER PROTECTION INSTALLATION SYSTEM

[76] Inventor: Gregory P. Albracht, 9623 Burdette, Omaha, Nebr. 68134

[21] Appl. No.: 688,404

[22] Filed: Jul. 30, 1996

Related U.S. Application Data

[63] Continuation-in-part of Ser. No. 414,271, Mar. 31, 1995, Pat. No. 5,557,891.

[60] Provisional application No. 60/002,017 Aug. 8, 1995.

[51] Int. Cl.[6] ..... E04D 13/076

[52] U.S. Cl. ..... 52/12; 52/712; 52/747.1; 52/748.1

[58] Field of Search ..... 52/12, 712, 747.1, 52/748.1

[56] References Cited

U.S. PATENT DOCUMENTS

| | | | |
|---|---|---|---|
| 603,611 | 5/1898 | Nye . | |
| 2,837,700 | 2/1959 | Heier . | |
| 2,847,949 | 8/1958 | Pond . | |
| 3,436,878 | 4/1969 | Singer | 52/12 |
| 4,036,761 | 7/1977 | Rankin | 52/12 X |
| 4,286,418 | 9/1981 | Snyder . | |
| 4,404,775 | 9/1983 | Demartini . | |
| 4,455,791 | 6/1984 | Elko et al. . | |
| 4,493,588 | 1/1985 | Duffy . | |
| 4,497,146 | 2/1985 | Demartini . | |
| 4,551,956 | 11/1985 | Axford . | |
| 4,571,896 | 2/1986 | Condie . | |
| 4,592,174 | 6/1986 | Hileman . | |
| 4,631,875 | 12/1986 | Olson . | |
| 4,745,710 | 5/1988 | Davis | 52/12 |
| 4,750,300 | 6/1988 | Winger, Jr. . | |
| 4,757,649 | 7/1988 | Vahldieck . | |
| 4,796,390 | 1/1989 | Demartini . | |
| 4,858,396 | 8/1989 | Rofe et al. . | |
| 4,866,890 | 9/1989 | Otto . | |
| 4,876,827 | 10/1989 | Williams . | |
| 4,937,986 | 7/1990 | Way, Sr. . | |
| 4,941,299 | 7/1990 | Sweers | 52/12 |
| 5,016,404 | 5/1991 | Briggs . | |
| 5,181,350 | 1/1993 | Meckstroth . | |
| 5,189,849 | 3/1993 | Collins . | |
| 5,216,851 | 6/1993 | Kuhns . | |
| 5,271,192 | 12/1993 | Nothum, Sr. et al. | 52/12 |

*Primary Examiner*—Christopher T. Kent
*Attorney, Agent, or Firm*—James D. Welch

[57] ABSTRACT

Disclosed is a gutter protection system which serves to protect gutter systems that collect rain water at the lower edges of sloping building roofs in use, while preventing the accumulation of debris therein. In particular, mounting clips in combination with hemmed gutter protection system design, which facilitate installation of gutter protection systems, are described.

11 Claims, 1 Drawing Sheet

GUTTER PROTECTION INSTALLATION SYSTEM

This is a Continuation-In-Part of Utility patent application Ser. No. 08/414,271 filed Mar. 31,1995, (now U.S. Pat. No. 5,557,891), and of Provisional patent application Ser. No. 60/002,017 filed Aug. 8, 1995.

TECHNICAL FIELD

The present invention relates to gutter systems which collect rain water at the lower edges of sloping building roofs, and to gutter protection systems which prevent the accumulation of debris in gutter systems during use, while allowing water to enter thereto. More particularly the present invention relates to hemmed gutter protection system design in combination with mounting clip designs, which simplify installation of gutter protection systems on K-style, Half-Round and Vinyl gutter systems.

BACKGROUND

The use of gutter systems at the lower edges of sloping building roofs to accumulate and direct rain water running-off thereof into downspouts for disposal at intended locations, is known. A problem associated with typical gutter systems during use thereof, however, is that they accumulate debris therein, such as leaves and twigs etc., and become clogged. This can occur as typical gutter systems are open at their upper ends. Clogged gutter systems can overflow and in addition to the nuisance created by the failure of said clogged gutter systems to direct water to intended downspouts for disposal at an intended location, can cause water to come into contact fascia and soffits etc. of the buildings to which they are applied. Constant contact with said water can cause damage to said fascia and soffits etc. In severe cases such, as during freezing weather, clogged gutters can develop ice damns, leading to the presence of sufficient weight in said gutter systems so as to actually dislodge them from said associated building. In even minor cases of clogging users must face the inconvenience of having to clean accumulated debris from the said gutter systems.

Inventors have noted the identified problem and responded with numerous systems which to lesser or greater degrees serve to overcome the identified problems. A very early, (1898), U.S. Pat. No. 603,611 to Nye, for instance describes, in the language of Nye, "an eves hanging trough having its inner wall carried upward above said trough, thence outward over said trough, and backward to the line of attachment to the roof, all in gentle curves . . . ". The Nye system operates by, via capillary action, directing water which runs off the roof of a building to which it is attached onto the portion of the inner wall thereof which is carried outward over the trough thereof and then into said trough, while simultaneously sweeping leaves and other debris off the system, and thereby preventing them from entering said trough. The Nye system is best visualized as comprising a backward "S" shape in side cross section, the upper edge of which is mounted to the eves of a building to which said Nye system is affixed. Another and more recent (1985) U.S. Pat. No. 4,493,588 to Duffy describes a system essentially similar to the Nye system, in which "[T] the curved portion overhangs the trough and a generally vertical screen extends between the trough and the curved portion . . . ". That is, a screen is present to further prevent leaves, twigs and other debris from entering the trough thereof. The upper edge of the Duffy system mounts under shingles on a roof of a building to which said system is affixed. Another more recent (1988) variation of a gutter system which provides benefits similar to those provided by the Nye invention is described in U.S. Pat. No. 4,757,649 to Vahldieck. The Vahldieck invention system comprises "a continuous double-curved convolute curve, generated on a first and second radius, which extends from the back wall, down short of the inside wall of the trough, and inward over the trough". The Vahldieck system is best visualized as being essentially of a squared "C" shape in side cross section, with the edge of the lower extent of said squared "C" shape being bent upward to form said trough, and with the with the upper extent of said squared "C" shape being curved downward in two stages, the second stage of which is defined by a tighter radius of curvature than in the first. In use, water running-off a roof of a building to which the Vahldieck system has been affixed follows, by capillary action, the double curved upper extent of said squared "C" shape and falls into the formed trough. Again, leaves and other debris are directed to locations other than into said trough. A 1989 Patent to Rose et al., U.S. Pat. No. 4,858,396 provides yet another variation on the same general theme "wherein a substantially flat extension which passes beneath the eves terminates in a free edge adjacent a narrow slot in an apex portion of an extended synthetic polymeric tube".

The Patents surveyed to this point serve to provide systems which are particularly applicable to new construction. That is, the Nye, Duffy, Vahldieck and Rose et al. systems provide gutters as a part thereof. Said systems are also applicable as replacements for existing gutter systems, but, said systems are not particularly relevant for retro-fit application to existing gutter systems. Inventors have however, during the 1980's and on into the 1990's, also provided numerous systems applicable for retro-fit to existing gutter systems. For instance, U.S. Pat. Nos. 4,404,775, 4,497,146 and 4,796,390 to Demartini describe systems "... which comprise a deflector having a sloped portion, the top edge region of which is adapted for juxtaposition to the roof shingles, and the bottom edge region of which is arcuate through a large radius cross-section. In such embodiments, the farthest outward extension is outside the outermost edge of the associated rain gutter and the lower edge is positioned between the edges of the rain gutter. Embodiments include means for attenuating the force of water and reducing the localized concentrating of water flowing thereover, such as longitudinal ridges and/or means for improving the surface wettability". The system can be visualized as essentially being "hook-shaped", (in side cross-section), in which, during use, the tip of the "hook" is oriented so as to face downward between the edges of an associated gutter system, and the shaft of said "hook" is positioned beneath shingles on the lower edge of the roof of a building to which the system is applied. Importantly, the Demartini Patents also describe numerous mounting means for use in mounting the described system to existing gutter systems. Another U.S. Pat. No. 4,455,791 to Elko et al., provides another system for similar use in retro-fit to existing gutter systems. "A protective structure for a gutter includes an elongated, impervious sheet wide enough to extend across at least about 90% of the width of the gutter and up under a lower edge of roofing material. The outer edge of the cover curls downwardly and the water follows the curvature by surface tension to cascade into the gutter. The cover may be held in place by straps that extend transversley across it and have one end engaged under the inwardly turned lip of the gutter and the other end engaged under roofing material". Alternatively clips can also be used for mounting the cover. Another Patent which describes a system for use in retro-fit to existing gutter systems is U.S. Pat. No. 5,016,404 to Briggs. This system provides that "[A] a sheet layer has an edge beneath the shingles and curves in front of and below the fascia above the gutter mouth forming a relatively small entrance region with the gutter. The apex of the curve extends beyond the gutter so that debris carried by water run off falls to the ground while the run off flows around the layer into the gutter". U.S. Pat. No. 5,189,849 to Collins describes a two piece roof rain gutter debris shield/run-off water control system. In the words of Collins, ". . . a roof slope adaptor and its alternate means accommodate every and all roof slope/gutter juxtaposition, thereby eliminating traditional installation problems, a support stabilizer functions to provide stability and rigidity, while preserving the integrity of critical embodiment dimensions, a slope adaptor affixation clip means provides a plurality of attachment means". In essence, a gutter shield embodiment is attached to and above a gutter by means of a support stabilizer, and provides a horizontally oriented capillary cap portion at an upper aspect thereof. A roof slope adaptor provides continuity between the roof of a building to which the system is affixed and said horizontally oriented capillary cap portion. The upper edge of said roof slope adaptor is placed under shingles at the lower edge of said roof and the lower edge thereof rests atop said horizontally oriented capillary cap portion.

Additional Patents describe the use of slots or openings in gutter shield systems. For instance a Patent to Otto, U.S. Pat. No. 4,866,890 describes "[A] a cover member for mounting on a conventional rain gutter on a building structure, consisting of a one piece thin, longitudinal shield to be inserted under the shingles of the roof and having a serrated outer edge which is bent downward a short distance back from its edge so that it can rest on the flat portion of the inner wall at the top lip of the qutter, the serrations providing small openings which water from the roof can run into the gutter and exclude pine straw or leaves from entering the gutter". Another U.S. Pat. No. 4,876,827 to Williams describes that "[T] the gutter assembly includes a curved water shed surface with a plurality of openings along its vertical portion which selectively allow the water to enter the gutter positioned below while excluding pine needles, leaves and other debris from engaging the gutter". U.S. Pat. No. 5,181,350 to Meckstroth describes that "[A] an elongated strip of extruded plastics material includes a generally flat longitudinally extending inner portion adapted to project under the shingles of a roof and a longitudinally extending outer portion adapted to seat on the outer edge portion of a rain gutter and project outwardly from the gutter to form a drip lip spaced from the gutter. A longitudinally extending intermediate portion of the strip integrally connects the inner portion to the outer portion and has a rounded nose surface above a U-shaped channel for directing water from the inner portion into the gutter and for deflecting leaves and other debris onto the outer portion of the strip for dropping them from the drip lip". U.S. Pat. No. 4,571,896 to Condie describes that "[A] a gutter assembly is provided which comprises an elongated, preferably transversely flexible sheet which when in an installed position extends along a building roof adjacent an edge of it, while extending below the roof edge. A pipe is provided which has a lengthwise extending slot which accommodates a side edge of the sheet through it adjacent an edge of the slot, while leaving room for entry of only water through the slot". "Such a gutter assembly inhibits entry of foreign matter into the pipe". A similar pipe arrangement is described in U.S. Pat. No. 4,551,956 to Axford. A Patent to Kuhns, U.S. Pat. No. 5,216,851 describes a system with an extended flat portion which does not contain any apertures and serves to close the open top of a gutter to which it is applied. The extended flat portion is connected to an apertured portion, which apertures portion connects to the upper lip of the front wall of a gutter via a lip portion thereof. Said apertures are shaped to direct water into the associated gutter while causing debris to simply flow over the outer front wall of the gutter. A Patent to Olsen, U.S. Pat. No. 4,631,875 describes a system with a generally planar surface which has a plurality of spaced parallel apertures which allow the entry of water into an underlying gutter. Patents to Way Sr. et al, U.S. Pat. No. 4,937,986 and to Pond, U.S. Pat. No. 2,847,949 describe gutter protection systems which provide an element which projects at a slope opposite to that of a roof to which the gutter they protect is attached, so that water exiting thereonto is slowed thereby. Both provide perforations in the oppositely sloped element so that water can enter to an underlying gutter.

The above survey of Patents shows that numerous systems for preventing clogging of gutter systems have been invented and Patented. Users of many of said systems, however, have found that there remains need for improvement, particularly as regards ease of system installation and effective operation. The present invention provides a system which demonstrates improvement over the known identified existing art.

DISCLOSURE OF THE INVENTION

The present invention is basically a gutter protection system which in use is affixed between a sloped building roof and a forward upper aspect of a gutter system. Said gutter system being affixed to a sloped roof building at a lower edge of, and below, said sloped roof. A major focus of the said gutter protection system is a hemmed section comprising, as viewed in right side elevation, a first downward and to the left projecting length of construction material which is merged into a first upward and to the right projecting length of construction material by way of an essentially one-hundred-eighty degree relatively tight bend. In use said gutter protection system further comprises at least one mounting clip secured at said hemmed section, said mounting clip being used in interfacing said gutter protection system to said forward upper aspect of said gutter system. Said at least one mounting clip can be placed so as to avoid gutter system mounting spikes and is provided limited three-dimensional rotational capability within said hemmed section.

A preferred embodiment of the present invention gutter protection system, in use, is affixed between a sloped building roof and a forward upper aspect of a gutter system, which gutter system is affixed to a sloped roof building at a lower edge of, and below, said sloped roof. Said gutter protection system, as viewed in right side elevation, prior to affixing to a sloped roof building, generally comprising a hemmed section, said hemmed section comprising a first downward and to the left projecting length of construction material which is merged into a first upward and to the right projecting length of construction material by way of an essentially one-hundred-eighty degree relatively tight bend. Said first upward and to the right projecting length of construction material merging, via a relatively tight bend, into a downward and to the right projecting length of construction material. Said downward and to the right projecting length of construction material being merged, via a relatively tight bend, into an upward and to the right projecting length of construction material. Said upward and to the right projecting length of construction material being comprised of openings which allow water flowing thereonto in use to pass therethrough and enter an underlying gutter system, and being merged, via a relatively tight bend, into an upward and to the left projecting length of construction material to a length such that a leftmost positioned end thereof is vertically above said first upward and to the right projecting length of construction material. Said upward and to the left projecting length of construction material being merged, via a relatively gradual bend, into a left major horizontally projecting length of construction material. Said left major horizontally projecting length of construction material being merged, via a relatively gradual bend, into an upward and to the right projecting length of construction material. Said upward and to the right projecting length of construction material being merged, via a relatively gradual bend, into a downward and to the left projecting length of construction material. Said downward and to the left projecting length of construction material being merged, via a relatively gradual bend, into an upward and to the left projecting length of construction material. Said upward and to the left projecting length of construction material being merged, via a relatively gradual shaped bend, into a right major horizontally to the right projecting length of construction material, and said right major horizontally to the right projecting length of construction material being merged into a horizontally to the left projecting length of construction material via an essentially one-hundred-eighty-degree bend.

In all preferred embodiments, said at least one mounting clip is secured to the hemmed section by causing a projecting lip thereof to be present between the downward and to the left and the upward and to the right lengths of construction material which form said hemmed section.

In the case where a "K-Style" gutter system is present, said mounting clip comprising a projecting lip, said projecting lip being projected upward and to the right, as viewed in right side elevation. Said projecting lip being merged into an arcuate shaped section of construction material which opens generally to the left, by way of a downward and to the right projecting length of construction material, and said arcuate shaped section of construction material is merged into a second upward and to the right projecting length of construction material, optionally via an essentially vertically upward projecting length of construction material. Said second upward and to the right projecting length of construction material is merged into a second downward and to the right length of construction material. The mounting clip elements beyond said projecting lip serving to facilitate interfacing to the forward upper aspect of a "K-style" gutter system in use.

In the case where a "Half-Round" gutter system is present, said mounting clip is secured thereto by causing a projecting lip thereof to be present between the downward and to the left and the upward and to the right lengths of construction material which form said hemmed section. Said projecting lip being projected upward and to the right, as viewed in right side elevation, and being merged into an open arcuate shaped section of construction material which opens generally downward, by way of a downward and typically to the left projecting length of construction material. At least one side said open arcuate shaped section of construction material is present a downward and outward, from a central position within said mounting clip, projecting length of construction material, said at least one mounting clip elements beyond said projecting lip serving to facilitate interfacing to the forward upper aspect of a "half-round" gutter system in use.

In the case where a vinyl gutter system is present said mounting clip is secured thereto by causing a projecting lip thereof to be present between the downward and to the left and the upward and to the right lengths of construction material which form said hemmed section. Said projecting lip being projected upward and to the right, as viewed in right side elevation, and being merged into a common point, by a downward and typically to the left projecting length of construction material. From said common point there are projected a right and a left leg. Said right leg comprises a downward and to the right length of construction material, said downward and to the right length of construction material being merged into an arcuate shaped section of construction material which opens generally to the left, said arcuate shaped section of construction material which opens to the left being merged into an arcuate shaped section of construction material which opens generally to the right. Said left leg comprises a downward and to the left projecting length of construction material. At the end of at least said left leg there is present a length of construction materials which projects generally downward and outward from said common point, said mounting clip elements beyond said projecting lip serving to facilitate interfacing to the forward upper aspect of a "vinyl" gutter system in use.

It is to be understood that a mounting clip is secured to said hemmed section comprised of a first downward and to the left projecting length of construction material which is merged into a first upward and to the right projecting length of construction material by way of an essentially one-hundred-eighty degree bend, by causing an upward and to the right projecting lip thereof to be present between the downward and to the left and the upward and to the right lengths of construction material which form said hemmed section. As viewed from above, it should be appreciated, said mounting clip can be rotated through some angle without being removed from said hemmed section, said rotation serving to facilitate installation of said gutter protection system to gutter systems which present with non-uniform forward upper aspects. As viewed in frontal elevation, it should be appreciated that said mounting clip can rotate through some limited angle by causing a lower portion of said hemmed section to bend.

A method of affixing a gutter protection system to a sloped roof building comprising the steps of:

a. Providing a gutter protection system as described infra herein.

b. Securing at least one mounting clip presenting with a projecting lip to said gutter protection system, by causing a projecting lip thereof to be present between the first downward and to the left and the first upward and to the right lengths of construction material which form said hemmed section.

c. Causing said left major horizontally to the right projecting length of construction material to assume an angle with respect to said major right horizontally to the right projecting length of construction material by a bending about intervening gutter protection system elements, said angle being selected to match the slope of said sloped building roof.

d. Simultaneously causing said at least one mounting clip to interface to a forward upper aspect of a gutter system which is affixed to said building at the edge of, and below, said sloped roof, and said right horizontally to the right projecting length of construction material to be inserted beneath a first row of shingles present at a lower extent of said sloped roof.

The present invention system will be better understood by reference to the Detailed Description Section herein, in conjunction with the accompanying drawings.

SUMMARY OF THE INVENTION

A purpose of the present invention is to provide a gutter protection system which prevents debris from entering to an underlying gutter system in use, while allowing water to enter thereto.

Another purpose of the present invention is to provide a gutter protection system of a design which facilitates easy mounting thereof to a sloped roof building.

Yet another purpose of the present invention is to provide mounting clips which are of designs which facilitate mounting of the present invention gutter protection system to "K-type", "Half-round" and "Vinyl" gutter systems.

DETAILED DESCRIPTION

Figure 1:
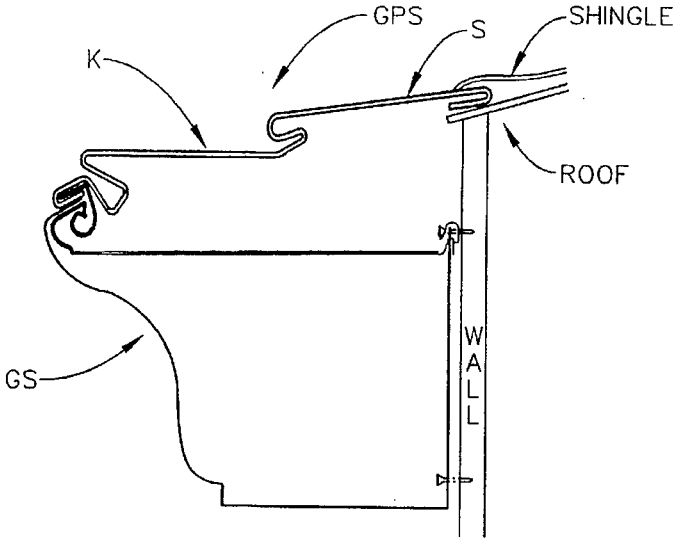
FIG. 1 generally shows a gutter protection system of the present invention mounted to gutter system present at a lower edge of a building sloped roof.

Turning now to the Drawings, it is indicated in FIG. 1 that the present invention is basically a gutter protection system (GPS) which in use is affixed between a sloped building roof (SR) and a forward upper aspect (FA) of a gutter system (GS). Said gutter system (GS) being affixed to a sloped roof building at a lower edge of, and below, said sloped roof.

Figure 2A:
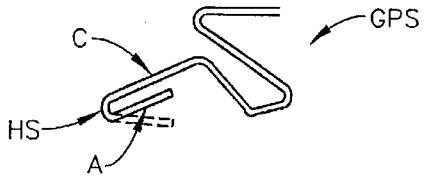
FIG. 2*a* shows a hemmed section of a present invention gutter protection system for use into which projecting lips of mounting clips are secured during use.
Figure 2B:
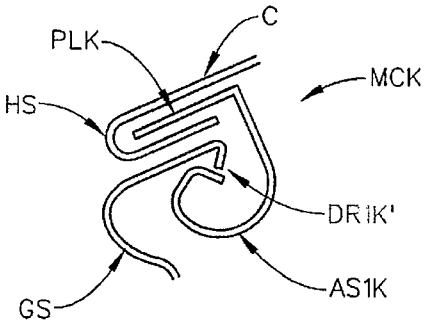
FIG. 2*b* shows a projecting lip of a mounting clip secured in a present invention gutter protection system hemmed section.

FIG. 2*a* shows that a major focus of the said gutter protection system is a hemmed section comprising, as viewed in right side elevation, a first downward and to the left projecting length of construction material (A) which is merged into a first upward and to the right projecting length of construction material (C) by way of an essentially one-hundred-eighty degree relatively tight bend (B). In use said gutter protection system further comprises at least one mounting clip secured at said hemmed section, said mounting clip being used in interfacing said gutter protection system to said forward upper aspect of said gutter system. FIG. 2*b* shows an expanded view of the gutter protection system (GPS) of FIG. 2*a* with a mounting clip (MCK), (see FIG. 4), projecting lip (PLK) secured in the hemmed section (HS), said mounting clip (MCK) being shown situated with respect to the upper forward portion of a gutter system (GS), as generally shown in FIG. 1. It should be appreciate that said projecting lip (PLK) can rotate in said hemmed section (HS), (in the plane of the paper as shown), to a limited degree by causing the lower portion of said hemmed section to bend downward, (indicated by the dotted and solid (A) lengths of construction material in FIG. 2*a*), and by effecting bending between, for instance, elements (PLK) and (AS1K) in FIG. 2*b*. This provides mounting facilitating capability where a gutter system is of irregular shape.

Figure 3A:
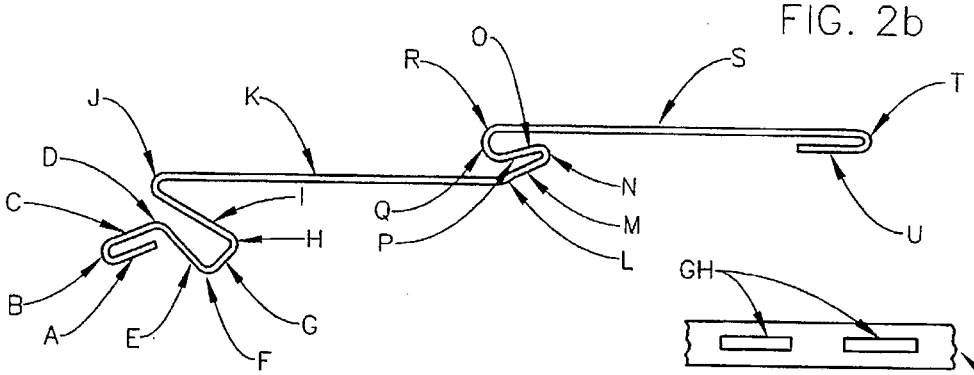
FIG. 3*a* shows a right side elevational profile of a preferred embodiment of a present invention gutter protection system.
Figure 3B:
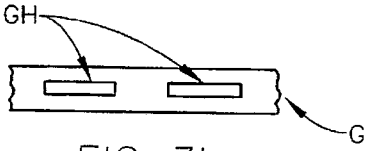
FIG. 3*b* shows holes in a section of the gutter protection system of FIG. 3*a* through which water can pass into an underlying gutter during use.

FIG. 3*a* shows that a preferred embodiment of the present invention gutter protection system can be disclosed by description of a right side elevational view thereof, prior to mounting thereof to a sloped roof building. Such a right side elevational view provides that said first downward and to the left projecting length of construction material (A) which is merged into a first upward and to the right projecting length of construction (C) material by way of an essentially one-hundred-eighty degree bend (B) involving construction material of approximately 0.093 inches long, is approximately 0.346 inches long, and said first upward and to the right projecting length of construction material (C), being approximately 0.383 inches long and merges, via a relatively tight bend (D) involving construction material of approximately 0.039 inches long, into a downward and to the right projecting length of construction material (E) of approximately 0.544 inches long. Said downward and to the right projecting length of construction material (E) is merged, via a relatively tight bend (F) involving construction material of approximately 0.0.086 inches long, into an upward and to the right projecting length of construction material (G) of approximately 0.231 inches long. Said upward and to the right projecting length of construction material (G) is comprised of openings (GH) (see FIG. 3*b*), which allow water flowing thereonto in use to pass therethrough and enter an underlying gutter system, and is merged, via a relatively tight bend (H) involving construction material of approximately 0.0.085 inches long, into an upward and to the left projecting length of construction material (I) of approximately 0.841 inches long, said length providing that a leftmost positioned end thereof, (at (J)), is vertically above said first upward and to the right projecting length of construction material (C). Said upward and to the left projecting length of construction material (I) being merged, via a relatively gradual bend (J) involving construction material of approximately 0.25 inches long, into a left major horizontally projecting length of construction material (K) of approximately 3.435 inches long. Said left major horizontally projecting length of construction material (K) is merged, via a relatively gradual bend (L) involving construction material of approximately 0.014 inches long, into an upward and to the right projecting length of construction material (M) of approximately 0.271 inches long. Said upward and to the right projecting length of construction material (M) is merged, via a relatively gradual bend (N) involving construction material of approximately 0.183 inches long, into a downward and to the left projecting length of construction material (O) of approximately 0.245 inches long. Said downward and to the left projecting length of construction material (O) is merged, via a relatively gradual bend (P) involving construction material of approximately 0.019 inches long, into an upward and to the left projecting length of construction material (Q) of approximately 0.125 inches long. Said upward and to the left projecting length of construction material (Q) is merged, via a relatively gradual shaped bend (R) involving construction material of approximately 0.139 inches long, into a right major horizontally to the right projecting length of construction material (S) of approximately 3.689 inches long, and said right major horizontally to the right projecting length of construction material (S) is merged into a horizontally to the left projecting length of construction material (U) of approximately 0.220 inches long via an essentially one-hundred-eighty-degree bend (T) involving construction material of approximately 0.104 inches long.

It is to be understood that the provided length dimensions are provided as demonstrative, and are not to be interpreted as limiting.

Continuing, in all preferred embodiments, said at least one mounting clip is secured to the hemmed section by causing a projecting lip thereof to be present between the downward and to the left and the upward and to the right lengths of construction material which form said hemmed section.

Figure 4:
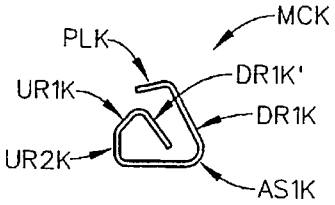
FIG. 4 shows a mounting clip appropriate for use in mounting the gutter protection system of FIG. 3*a* to a "Type-K" gutter system.

FIG. 4 shows that, in the case where a "K-Style" gutter system is present, said mounting clip (MCK) comprises a projecting lip, said projecting lip (PLK) being projected upward and to the right, as viewed in right side elevation. Said projecting lip (PLK) is caused to be present between the downward and to the left (A) and the upward and to the right (C) lengths of construction material which form said hemmed section in use. Said projecting lip (PLK) is merged into an arcuate shaped section (AS1K) of construction material which opens generally to the left, by way of a downward and to the right projecting length of construction material (DR1K), and said arcuate shaped section (AS1K) of construction material is merged into a second upward and to the right projecting length of construction material (UR1K) via an essentially vertically upward projecting length of construction material (UR2K). Said second upward and to the right projecting length of construction material (UR1K) is merged into a second downward and to the right length of construction material (DR1K'). Note that said essentially vertically upward projecting length of construction material (UR2K) can be eliminated in a modified embodiment and/or element (AS1K) can be more arcuate in shape with element (DR1K) less pronounced, (as shown in FIG. 2 for instance). The mounting clip elements beyond said projecting lip serving to facilitate interfacing to the forward upper aspect of a "K-style" gutter system in use.

Figure 5:
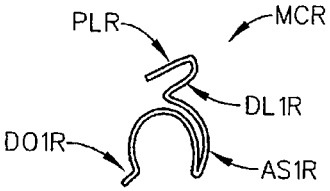
FIG. 5 shows a mounting clip appropriate for use in mounting the gutter protection system of FIG. 3*a* to a "Half-Round" gutter system.

Turning now to FIG. 5, in the case where a "Half-Round" gutter system is present, said mounting clip (MCR) is shown as secured thereto by causing a projecting lip (PLR) thereof to be present between the downward and to the left (A) and the upward and to the right (C) lengths of construction material which form said hemmed section. Said projecting lip (PLR) being projected upward and to the right, as viewed in right side elevation, and being merged into an open arcuate shaped section (AS1R) of construction material which opens generally downward, by way of a downward and typically to the left projecting length of construction material (DL1R). At least one side said open arcuate shaped section of construction material is present a downward and outward, (DO1R) from a central position within said mounting clip, projecting length of construction material, said at least one mounting clip elements beyond said projecting lip serving to facilitate interfacing to the forward upper aspect of a "half-round" gutter system in use. In particularly, the downward and outward projecting length of construction material ((DO1R) serves to assure that the open arcuate shaped section (AS1R) will spread open when said mounting clip (MCR) is placed onto a "Half-Round" gutter system.

Figure 6:
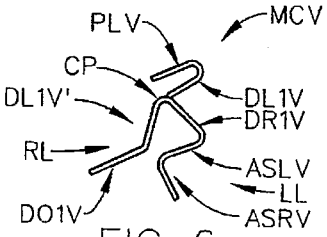
FIG. 6 shows a mounting clip appropriate for use in mounting the gutter protection system of FIG. 3*a* to a "Vinyl" gutter system.

Turning now to FIG. 6, in the case where a vinyl gutter system is present said mounting clip (MCV) is shown as secured thereto by causing a projecting lip (PLV) thereof to be present between the downward and to the left (A) and the upward and to the right (C) lengths of construction material which form said hemmed section. Said projecting lip (PLV) being projected upward and to the right, as viewed in right side elevation, and being merged into a common point (CP), by a downward and typically to the left projecting length of construction material (DL1V). From said common point (CP) there are projected a right (RL) and a left leg (LL). Said right leg (RL) comprises a downward and to the right length of construction material (DR1V), said downward and to the right length of construction material (DR1V) being merged into an arcuate shaped section of construction material (ASLV) which opens generally to the left, said arcuate shaped section of construction material (ASLV) which opens to the left being merged into an arcuate shaped section of construction material (ASRV) which opens generally to the right. Said left leg (LL) comprises a downward and to the left projecting length of construction material (DL1V'). At the end of at least said left leg there is present a length of construction material which projects generally downward and outward from said common point (DO1V). Said mounting clip (MCV) elements beyond said projecting lip (PLV) serve to facilitate interfacing to the forward upper aspect of a "Vinyl" gutter system in use. In particular, the shown generally downward and outward to the left length of construction material from said common point (DO1V), and the lower portion of arcuate shaped length of construction material (ASRV) which projects to the right, provide a shape which assures that said elements will spread apart when said mounting clip (MCR) is placed onto a "Vinyl" gutter system. (It is noted that the arcuate shaped section of construction material (ASLV) which opens generally to the left, and said arcuate shaped section of construction material (ASRV) which opens generally to the right, as shown, can involve very tight bends rather than gradual arcuate shapes).

It is to be understood that a mounting clip is secured to said hemmed section comprised of a first downward and to the left (A) projecting length of construction material which is merged into a first upward and to the right projecting length of construction material (C) by way of an essentially one-hundred-eighty degree bend (B), by causing an upward and to the right projecting lip (PL) thereof to be present between the downward and to the left (A) and the upward and to the right (C) lengths of construction material which form said hemmed section (HS).

Figure 7A:
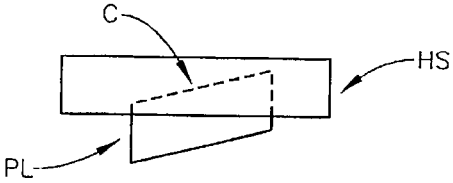
FIGS. 7*a* and 7*b* demonstrate the flexibility provided by mounting clip projecting lip and gutter protection system hemmed section coordination, in that the projecting lip can essentially rotate a bit within said hemmed section.
Figure 7B:
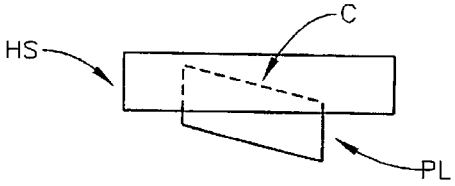

Turning now to FIGS. 7*a* and 7*b*, it will be appreciated that, as viewed from above, a mounting clip projecting lip (PL) can be rotated through some angle, (in the plane of the paper as shown), without being removed from said hemmed section (HS), said rotation serving to facilitate installation of said gutter protection system to gutter systems which present with non-uniform shaped forward upper aspects. In conjunction with the available third-dimensional rotation motion described with respect to FIG. 2*b*, (see infra herein), it should be appreciate that said projecting lip (PLK) can rotate in said hemmed section (HS) to limited degrees in three-dimensions. This provides a user great mounting facilitating capability and is considered a very important aspect of the present invention.

It is noted that while drawings do not specifically show half-round and vinyl gutter systems, the shape of present invention mounting clip mating forward upper aspects of such gutter systems can be appreciated by understanding that the shape of the mounting clips are such so as to "snap" thereover and thereonto in use.

It is generally noted that relatively tight bends can be approximated by gradual arcuate shapes, (and vice versa), which perform the same function, in all the structure described infra herein, particularly as regards the shape of the various mounting clips. The Claims should be read as sufficiently broad to include such functionally equivalent interpretations.

Having hereby disclosed the subject matter of the present invention, it should be obvious that many modifications, substitutions, and variations thereof are possible in light thereof. It is therefore to be understood that the present invention can be practiced other than as specifically described, and should be limited in breadth and scope only by the Claims.

I claim:

1. A gutter protection system which in use is affixed between a sloped building roof and a forward upper aspect of a gutter system, when said gutter system is affixed to a sloped roof building at a lower edge of, and below, said sloped roof; said gutter protection system comprising a hemmed section comprising, as viewed in right side elevation, a first downward and to the left projecting length of construction material which is merged into a first upward and to the right projecting length of construction material by way of an essentially one-hundred-eighty degree relatively tight bend, said gutter protection system further comprising at least one mounting clip secured at said hemmed section, said at least one mounting clip being used in interfacing said gutter protection system to said forward upper aspect of said gutter system; said at least one mounting clip being secured to said hemmed section of said gutter protection system by causing a projecting lip of said at least one mounting clip to be present between said first downward and to the left and said first upward and to the right lengths of construction material which form said hemmed section of said gutter protection system.

2. A gutter protection system as in claim 1, in which said mounting clip projecting lip is projected upward and to the right as viewed in right side elevation, said projecting lip being merged into an arcuate shaped section of construction material which opens generally to the left, by way of a downward and to the right projecting length of construction material, said arcuate shaped section of construction material being merged into a second upward and to the right projecting length of construction material, by a means selected from the group consisting of: (directly and via an essentially vertically projecting length of construction material), and said second upward and to the right projecting length of construction material being merged into a second downward and to the right length of construction material, said at least one mounting clip sections and lengths of construction material beyond said projecting lip serving to facilitate interfacing to a forward upper aspect of a "K-style" gutter system in use.

3. A gutter protection system as in claim 1, in which said mounting clip projecting lip is projected upward and to the right, as viewed in right side elevation, and is merged into an open arcuate shaped section of construction material which opens generally downward, by way of a generally downward projecting length of construction material, at the end of at least one side of said open arcuate shaped section of construction material is present a downward and outward, from a central position within said mounting clip, projecting length of construction material, said at least one mounting clip sections and lengths of construction material beyond said projecting lip serving to facilitate interfacing to a forward upper aspect of a "half-round" gutter system in use, by causing said generally downward opening arcuate shaped length of construction material to spread and slide over said forward upper aspect of a half-round gutter system in use.

4. A gutter protection system as in claim 1, in which said mounting clip projecting lip is projected upward and to the right, as viewed in right side elevation, and is merged into a common point, by a generally downward projecting length of construction material, from which common point there are projected a right and a left leg, said right leg comprising a downward and to the right projecting length of construction material, said downward and to the right projecting length of construction material being merged into an arcuate shaped section of construction material which opens generally to the left, said arcuate shaped section of construction material which opens generally to the left being merged into an arcuate shaped section of construction material which opens generally to the right; and said left leg comprising a downward and to the left projecting length of construction material; at the end of at least said left leg there being a length of construction material which projects generally downward, and outward from said common point, said at least one mounting clip sections and lengths of construction material beyond said projecting lip serving to facilitate interfacing to a forward upper aspect of a "vinyl" gutter system in use by causing said right and left legs to spread and slide over said forward upper aspect of said "vinyl" gutter system in use.

5. A gutter protection system as in claim 1, which as viewed in right side elevation prior to being affixed to said sloped roof building at the edge of, and below, said sloped roof, further comprises a downward and to the right projecting length of construction material merging, via a tight bend, from said first upward and to the right projecting length of construction material, said downward and to the right projecting length of construction material being merged, via a tight bend, into an upward and to the right projecting length of construction material, said upward and to the right projecting length of construction material being merged, via a tight bend, into an upward and to the left projecting length of construction material to a length such that a leftmost positioned end thereof is vertically above said first upward and to the right projecting length of construction material, said upward and to the left projecting length of construction material being merged, via a gradual arcuate shaped bend, into a left major horizontally to the right projecting length of construction material, said left major horizontally to the right projecting length of construction material being merged, via a gradual bend, into an upward and to the right projecting length of construction material, said upward and to the right projecting length of construction material being merged, via a gradual arcuate shaped bend, into a downward and to the left projecting length of construction material, said downward and to the left projecting length of construction material being merged, via a gradual bend, into an upward and to the left projecting length of construction material, said upward and to the left projecting length of construction material being merged, via a gradual arcuate shaped bend, into a right major horizontally to the right projecting length of construction material, and said right major horizontally to the right projecting length of construction material being merged into a horizontally to the left projecting length of construction material via an essentially one-hundred-eighty-degree bend.

6. A gutter protection system which in use is affixed between a sloped building roof and a forward upper aspect of a gutter system, which gutter system is affixed to a sloped roof building at a lower edge of, and below, said sloped roof; said gutter protection system, as viewed in right side elevation, prior to affixing to a sloped roof building, comprises a hemmed section, said hemmed section comprising a first downward and to the left projecting length of construction material which is merged into a first upward and to the right projecting length of construction material by way of an essentially one-hundred-eighty degree bend, said first upward and to the right projecting length of construction material merging, via a relatively tight bend, into a downward and to the right projecting length of construction material, said downward and to the right projecting length of construction material being merged, via a relatively tight bend, into an upward and to the right projecting length of construction material, said upward and to the right projecting length of construction material being comprised of openings which allow water flowing thereonto in use to pass therethrough and enter an underlying gutter system, and being merged, via a relatively tight bend, into an upward and to the left projecting length of construction material to a length such that a leftmost positioned end thereof is vertically above said first upward and to the right projecting length of construction material, said upward and to the left projecting length of construction material being merged, via a relatively gradual bend, into a left major horizontally to the right projecting length of construction material, said left major horizontally to the right projecting length of construction material being merged, via a relatively gradual bend, into an upward and to the right projecting length of construction material, said upward and to the right projecting length of construction material being merged, via a relatively gradual bend, into a downward and to the left projecting length of construction material, said downward and to the left projecting length of construction material being merged, via a relatively gradual bend, into an upward and to the left projecting length of construction material, said upward and to the left projecting length of construction material being merged, via a relatively gradual shaped bend, into a right major horizontally to the right projecting length of construction material, and said right major horizontally to the right projecting length of construction material being merged into a horizontally to the left projecting length of construction material via an essentially one-hundred-eighty-degree bend.

7. A gutter protection system as in claim 6 in which said first downward and to the left projecting length of construction material which is merged into a first upward and to the right projecting length of construction material by way of an essentially one-hundred-eighty degree bend involving construction material of approximately 0.093 inches long, is approximately 0.346 inches long, said first upward and to the right projecting length of construction material being approximately 0.383 inches long and merging, via a relatively tight bend involving construction material of approximately 0.039 inches long, into a downward and to the right projecting length of construction material of approximately 0.544 inches long, said downward and to the right projecting length of construction material being merged, via a relatively tight bend involving construction material of approximately 0.086 inches long, into an upward and to the right projecting length of construction material of approximately 0.231 inches long, said upward and to the right projecting length of construction material being comprised of openings which allow water flowing thereonto in use to pass therethrough and enter an underlying gutter system, and being merged, via a relatively tight bend involving construction material of approximately 0.085 inches long, into an upward and to the left projecting length of construction material of approximately 0.841 inches long, said length providing that a leftmost positioned end thereof is vertically above said first upward and to the right projecting length of construction material, said upward and to the left projecting length of construction material being merged, via a relatively gradual bend involving construction material of approximately 0.25 inches long, into a left major horizontally to the right projecting length of construction material of approximately 3.435 inches long, said left major horizontally to the right projecting length of construction material being merged, via a relatively gradual bend involving construction material of approximately 0.014 inches long, into an upward and to the right projecting length of construction material of approximately 0.271 inches long, said upward and to the right projecting length of construction material being merged, via a relatively gradual bend involving construction material of approximately 0.183 inches long, into a downward and to the left projecting length of construction material of approximately 0.245 inches long, said downward and to the left projecting length of construction material being merged, via a relatively gradual bend involving construction material of approximately 0.019 inches long, into an upward and to the left projecting length of construction material of approximately 0.125 inches long, said upward and to the left projecting length of construction material being merged, via a relatively gradual shaped bend involving construction material of approximately 0.139 inches long, into a right major horizontally to the right projecting length of construction material of approximately 3.689 inches long, and said right major horizontally to the right projecting length of construction material being merged into a horizontally to the left projecting length of construction material of approximately 0.220 inches long via an essentially one-hundred-eighty-degree bend involving construction material of approximately 0.104 inches long.

8. A gutter protection system as in claim 1, in which said mounting clip is secured to said hemmed section such that as viewed from above, said mounting clip projecting lip can be rotated without being removed from said hemmed section, and such that as viewed in right side elevation said mounting clip projecting lip can be rotated without being removed from said hemmed section, said rotations serving to, in combination with positioning along a length of gutter protection system, allow limited three-dimensional motion of said at least one mounting clip without removal of said projecting lip thereof from said hemmed section, and thereby facilitate installation of said gutter protection system to gutter systems which present with non-uniform forward upper aspects.

9. A method of affixing a gutter protection system to a sloped roof building comprising the steps of:

a. providing a gutter protection system which in use is affixed between a sloped building roof and a forward upper aspect of a gutter system, which gutter system is affixed to a sloped roof building at a lower edge of, and below, said sloped roof; said gutter protection system, as viewed in right side elevation, prior to affixing to a sloped roof building, comprising a hemmed section, said hemmed section comprising a first downward and to the left projecting length of construction material which is merged into a first upward and to the right projecting length of construction material by way of an essentially one-hundred-eighty degree relatively tight bend, said first upward and to the right projecting length of construction material merging, via a relatively tight bend, into a downward and to the right projecting length of construction material, said downward and to the right projecting length of construction material being merged, via a relatively tight bend, into an upward and to the right projecting length of construction material, said upward and to the right projecting length of construction material being comprised of openings which allow water flowing thereonto in use to pass therethrough and enter an underlying gutter system, and being merged, via a relatively tight bend, into an upward and to the left projecting length of construction material to a length such that a leftmost positioned end thereof is vertically above said first upward and to the right projecting length of construction material, said upward and to the left projecting length of construction material being merged, via a relatively gradual bend, into a left major horizontally to the right projecting length of construction material, said left major horizontally to the right projecting length of construction material being merged, via a relatively gradual bend, into an upward and to the right projecting length of construction material, said upward and to the right projecting length of construction material being merged, via a relatively gradual bend, into a downward and to the left projecting length of construction material, said downward and to the left projecting length of construction material being merged, via a relatively gradual bend, into an upward and to the left projecting length of construction material, said upward and to the left projecting length of construction material being merged, via a relatively gradual shaped bend, into a right major horizontally to the right projecting length of construction material, and said right major horizontally to the right projecting length of construction material being merged into a horizontally to the left projecting length of construction material via an essentially one-hundred-eighty-degree bend;

b. securing at least one mounting clip presenting with a projecting lip to said gutter protection system, by causing a projecting lip thereof to be present between the first downward and to the left and the first upward and to the right lengths of construction material which form said hemmed section;

c. causing said left major horizontally to the right projecting length of construction material to assume an angle with respect to said right major horizontally to the right projecting length of construction material by a bending about intervening gutter protection system merging lengths of construction material, said angle being selected to match the slope of said sloped building roof; and d. simultaneously causing said at least one mounting clip to interface to said forward upper aspect of said gutter system which is affixed to said building at the edge of, and below, said sloped roof, and said right horizontally to the right projecting length of construction material to be inserted beneath a first row of shingles present at a lower extent of said sloped roof.

10. A gutter protection system which in use is affixed between a sloped building roof and a forward upper aspect of a gutter system, when said gutter system is affixed to a sloped roof building at a lower edge of, and below, said sloped roof; said gutter protection system comprising a hemmed section comprising, a first length of construction material which is merged into a second length of construction material by way of a bend, said gutter protection system further comprising at least one mounting clip secured at said hemmed section, said at least one mounting clip being used in interfacing said gutter protection system to said forward upper aspect of said gutter system, said at least one mounting clip being secured to said hemmed section of said gutter protection system by causing a projecting lip of said at least one mounting clip to be present between said first and second lengths of construction material which form said hemmed section of said gutter protection system; such that as viewed from above, said mounting clip projecting lip can be rotated without being removed from said hemmed section, and such that as viewed in side elevation said mounting clip projecting lip can be rotated without being removed from said hemmed section, said rotations serving to, in combination with positioning along a length of gutter protection system, allow limited three-dimensional motion of said at least one mounting clip without removal of said projecting lip thereof from said hemmed section, and thereby facilitate installation of said gutter protection system to gutter systems which present with non-uniform forward upper aspects.

11. A gutter protection system as in claim 10, in which said mounting clip projecting lip is projected so as to fit into said hemmed section, and said mounting clip as viewed in right side elevation, is further comprised of a shape selected from the group consisting of:

a. said mounting clip projecting lip being merged into an arcuate shaped section of construction material which opens generally to the left, by way of a downward and to the right projecting length of construction material, said arcuate shaped section of construction material being merged into a second upward and to the right projecting length of construction material, by a means selected from the group consisting of: (directly and via an essentially vertically projecting length of construction material), and said second upward and to the right projecting length of construction material being merged into a second downward and to the right length of construction material, said at least one mounting clip sections and lengths of construction material beyond said projecting lip serving to facilitate interfacing to a forward upper aspect of a "K-style" gutter system in use;

b. said mounting clip projecting lip being merged into an open arcuate shaped section of construction material which opens generally downward, by way of a generally downward projecting length of construction material, at the end of at least one side of said open arcuate shaped section of construction material is present a downward and outward, from a central position within said mounting clip, projecting length of construction material, said at least one mounting clip sections and lengths of construction material beyond said projecting lip serving to facilitate interfacing to the forward upper aspect of a "half-round" gutter system in use, by causing said generally downward opening arcuate shaped length of construction material to spread and slide over said forward upper aspect of a half-round gutter system in use;

c. said mounting clip projecting lip being merged into a common point, by a generally downward projecting length of construction material, from which common point there are projected a right and a left leg, said right leg comprising a downward and to the right projecting length of construction material, said downward and to the right projecting length of construction material being merged into an arcuate shaped section of construction material which opens generally to the left, said arcuate shaped section of construction material which opens generally to the left being merged into an arcuate shaped section of construction material which opens generally to the right; and said left leg comprising a downward and to the left projecting length of construction material; at the end of at least said left leg there being a length of construction material which projects generally downward, and outward from said common point, said at least one mounting clip sections and lengths of construction material beyond said projecting lip serving to facilitate interfacing to a forward upper aspect of a "vinyl" gutter system in use by causing said right and left legs to spread and slide over the forward upper aspect of the "vinyl" gutter system in use.

* * * * *